US005645411A

United States Patent [19]

Schaupert et al.

[11] Patent Number: 5,645,411

[45] Date of Patent: Jul. 8, 1997

[54] RADIATION GAS BURNER WITH SAFETY DEVICE

[75] Inventors: Kurt Schaupert, Hofheim-Wallau; Michael Kahlke, Mainz-Kastel, both of Germany

[73] Assignee: Schott Glaswerke, Mainz, Germany

[21] Appl. No.: 543,118

[22] Filed: Oct. 13, 1995

[30] Foreign Application Priority Data

Oct. 20, 1994 [DE] Germany ..... 44 37 510.7

[51] Int. Cl.[6] ..... F23N 5/00

[52] U.S. Cl. ..... 431/77; 431/80; 431/328; 126/39 J

[58] Field of Search ..... 431/78, 13, 75, 431/41, 77, 80, 326, 328, 329, 327, 42, 76; 126/39 J, 39 K, 39 N, 91 R, 92 AC, 39 R

[56] References Cited

U.S. PATENT DOCUMENTS

| | | | |
|---|---|---|---|
| 4,083,355 | 4/1978 | Schwank . | |
| 4,201,184 | 5/1980 | Scheidler et al. | 126/39 J |
| 5,240,406 | 8/1993 | Kanesaka | 431/80 |
| 5,393,222 | 2/1995 | Sutton | 431/80 |

FOREIGN PATENT DOCUMENTS

| | | |
|---|---|---|
| 396028 | 4/1990 | Australia . |
| 0433209 | 10/1990 | European Pat. Off. . |
| 0638771 | 5/1994 | European Pat. Off. . |
| 2440701 | 8/1974 | Germany . |
| 2633849 | 7/1976 | Germany . |
| 2641274 | 9/1976 | Germany . |
| 2621801 | 9/1982 | Germany . |
| 3315745 | 10/1984 | Germany . |
| 8625847 | 9/1986 | Germany . |
| 3409334 | 8/1987 | Germany . |
| 3732271 | 9/1987 | Germany . |
| 4022844 | 7/1990 | Germany . |
| 4112449 | 10/1991 | Germany . |

OTHER PUBLICATIONS

Patent Abstracts of Japan, vol. 14, No. 97, Feb. 22, 1990.

*Primary Examiner*—James C. Yeung
*Attorney, Agent, or Firm*—Michael J. Striker

[57] ABSTRACT

A gas radiation burner has a burner plate, and a safety element providing an ignition safety for non-burnt discharging gas for igniting gas or interrupting a gas supply. The safety element is formed as a temperature measuring resistance which contacts the burner plate via electrical conductors and is composed of a material of the burner plate.

13 Claims, 3 Drawing Sheets

RADIATION GAS BURNER WITH SAFETY DEVICE

BACKGROUND OF THE INVENTION

The present invention relates to a radiation gas burner with safety device.

More particularly, it relates to radiation gas burner with a safety device with an electrical ignition safety against non-burnt discharge gas and thereby devices for ignition of the gas for interruption of the gas supply during extinguishing of the flame.

Radiation gas burners are known in the art. One of such gas radiation burners is disclosed for example in the German patent document DE 24 40 701 C3. The gas radiation burner disclosed in this document has a porous, perforated burner plate composed for example ceramics and closing from above a mixing chamber of the gas burner. During the operation no flame burns at the upper end of the passage of the perforated or holed burner plate, and the burner plate is brought to glowing and operates as a heat radiator. The temperature of the radiating burner plates is substantially between 900° C. and 950° C., depending on the temperature resistance of the material of the burner plate.

These radiation burners are used for example for space heating, in hot water preparation devices, in drying systems, and in particular in gas cooking devices. Gas cooking devices with gas radiation burners and glass ceramic cooking plates are known in many forms and described for example in the German patent document DE-OS 26 21 801, DE 33 15 745 A1 and U.S. Pat. Nos. 4,083,355 and 4,201,184.

A gas cooking device has one or several gas radiation burners arranged at a distance from one another under a joint known glass ceramic plate. Each burner defines a cooking point on the upper side of the glass ceramic plate. Each individual gas radiation burner is provided with an ignition device and an ignition safety device. The ignition safety device is used for monitoring the presence of the flame. If the flame is extinguished due to operational disturbances, measures have to be taken again for the discharge of non-burnt combustion gas mixture. Several solutions are proposed for this purpose.

The German patent document DE 34 09 334 C2, and European patent document EP - 433 209 A1 disclose a solution in accordance with which the pilot flame used for a back ignition of the burner is thermoelectrically monitored. In the German document DE 26 21 801 C2 the ionization monitoring of the hot discharge gas through the burner plate is provided. In the German document DE G 86 25 847 U1 and DE 37 32 271 C2 the thermoelectric monitoring of the main burner is provided. The German document DE 26 33 849 C3 utilizes a periodic spark ignition of the main burner. Finally, the German document DE 26 41 274 C3 utilizes a glow ignition in continuous operation with the thermoelectric monitoring.

These solutions have the disadvantage that on the one hand they are technically expensive and on the other hand the thermoelectric monitoring for example of the ignition device or the main burner provides only an indirect control of the orderly operation of the burner.

SUMMARY OF THE INVENTION

Accordingly, it is an object of the present invention to provide a radiation gas burner with a safety device, which avoids the disadvantages of the prior art.

In keeping with these objects and with others which will become apparent hereinafter, one feature of the present invention resides, briefly stated, in a radiation gas burner which has a burner plate, and safety means including an integrated ignition safety device against non-burnt discharge gas and integrated in the burner plate and also including devices cooperating with the ignition safety device for igniting the gas or interrupting the gas supply during extinguishing of the flame wherein the ignition safety device includes a temperature measuring resistance which contacts the burner plate via an electrical connection and is composed of a material of the burner plate.

When the radiation burner is designed in accordance with the present invention, it is provided with a cost favorable and operationally reliable safety means which provides a monitoring directly at the location of the flame.

In accordance with the invention the ignition safety device is provided directly on the burner plate. The solution in accordance with the present invention utilizes the fact that the conventional materials of the burner plates such as for example ceramics or metals, have a substantially temperature-dependent electrical resistance. Therefore the operational condition of the burner can be determined in a simple way by measuring the electrical resistance of the material of the burner plate. It is therefore sufficient to provide the burner plate at the predetermined points with electrical connections which are connected with a corresponding evaluating circuit. In some cases, an electrical insulation of the burner plate from the metallic mixing chamber of the burner must be provided. Depending on the signals obtained on the burner plate, the evaluating device can actuate the ignition devices provided on the burner plate, such as for example glow igniter, spark igniter, etc., or also valves for interruption of the gas supply to the respective burner plate.

In the inventive radiation burner, it is possible to use for the burner plates all materials whose electrical resistance is sufficiently high and sufficiently changes within the temperature region 100°–900° C. relevant for the inventive application. In order to provide a simple regulation it suffices when the resistance in the above described temperature region changes by at least 10%, preferably by 20%. The speed of the change of the temperature and thereby the resistance must be so great that the safety time between extinguishing of the flame and blocking of the gas supply or a new ignition is maintained within the corresponding standards (for Europe EN 30). High temperature resistant materials with high positive or negative temperature coefficients are especially suitable for this purpose.

The inventive solution is preferably used for burner plates composed of fiber materials, for example metal or ceramic fibers. The reason is that their thermal mass is very low, which leads to a fast temperature change and resistance change. Especially advantageous are burner plates of the firm "Global Environmental Solution" which are composed of SiC-fibers, such as described for example in "Advanced Gas-Powered Smoothtop", Proceedings of the International Appliance Technical Conference, Madison, Wis., May 10–11, 1994. This burner plate material not only has a suitable resistance/temperature course, but also because of its low thermal mass it reacts fast to changes in the burner power output. The details thereof are disclosed in the description of corresponding embodiments.

Electric circuits which can be used for the inventive gas radiation burner are well known in the prior art and can be formed in different ways. The evaluating circuit can include a current source, a signal amplifier, a switch amplifier and a magnetic valve. Such circuits are well known to persons of ordinary skill in the art. The evaluation is performed by evaluating the absolute value of the resistance signal. For example, a predetermined resistance value which corresponds to a predetermined current can be utilized as a threshold value for releasing a new ignition or turning off the gas supply. After successful ignition, a burner plate of SiC-fibers with the conventional dimensions of for example 180 mm diameter reaches after 5 seconds a temperature of approximately 700° C. During the heating up, the specific electrical resistance of a suitable SiC-fiber material falls for example from $2\times10^4$ to under $10^3\Omega\times$cm.

Since for a specific burner the resistance value both in cold and hot conditions is known, these both values can be used for monitoring the burner by a suitable evaluating circuit, in some case with adding a safety supplement for consideration of eventual changes of the resistance. If the resistance is in the order or the upper value, this snows that no flame burns. This leads to a new ignition or to turning off of the gas supply after several ignition attempts or elapsing of a predetermined time. If the resistance is in the region of the lower value the burner burns unobjectionably. If the resistance is very small, a short circuiting occurs, and if the resistance is very high, an interruption occurs. For safety reasons both situations must lead to turning off of the gas supply.

Alternatively to the evaluation of the absolute value, it is also possible to use the change of the resistance signal with the time. In this case the evaluation circuit is additionally provided with a differentiator. The change of the signal is very high during switching on and switching off moments as shown in FIG. 6. Their evaluation represents a process which also contains the safety time and simultaneously is free of slow material changes, such as aging, or a drift of the evaluating electronic system. When no resistance change occurs during switching on or switching off, this is the indication that a short circuiting or an interruption takes place, which leads to a response of the safety circuit.

The electronic evaluation can be performed with the use of direct current, alternating current or a pulse-shaped signal. Since the resistance of the plate during the operation must be within a predetermined region, it can be used for recognition of short-circuiting or interruption in the conduit between the burner plate and the electronic device. Also, the evaluation of pulse-shaped signals can be used for improving the safety of the whole system, since in this situation not only voltage must be provided, which eventually can also occur as disturbance, but also the signal must have the correct frequency.

The inventive temperature resistor of the material of the burner plate can be used additionally for a temperature monitoring of the burner plate.

When the burner plates are composed of fiber material, for example SiC-fibers, it is advantageous to interlace an individual fiber or a fiber bundle into the burner plate and pass the ends through the plate upwardly or downwardly. It is advantageous that in this situation a simple contacting of the wire shaped conductor is provided. Furthermore, because of the fiber/fiber bundle, a very well defined geometry of the temperature sensor is obtained, so that low tolerances during manufacture can be used.

With this approach also several fibers can be applied on a plate, so that a central region and an edge region can be evaluated separately. In this way, a method disclosed in the German patent document DE-PS 40 22 844 and U.S. Pat. No. 5,227,610 for glass ceramic cooking surfaces with an integrated temperature sensor can be utilized for different heating of the central and edge regions responsible for the overheating. For example, it is possible to distinguish between the use of poor ware and idle running without ware. With a typical arrangement, in the idle operation, the temperature in the central area is 950° C. and in the edge area 930° C., while with the use of a poor top the temperature in the middle region is 980° C. and in the edge region 900° C.

When the burner is provided with the safety means in accordance with the present invention it is not necessary to produce the burner plates completely from SiC. It is however important that the heated upper layer of the burner plate is composed of SiC. The burner plates in particular for large sizes can have a sandwich construction including a mechanical supporting structure and an active fiber plate.

The solution according to the present invention has the important advantage that the safety monitoring is performed directly at the location, at which the actual flame is produced or extinguished. A diversion through indirect measurements, as in the prior art, are not needed. Therefore a substantially greater safety is guaranteed. Also, the inventive safety device for the gas radiation burner has a simple and inexpensive construction.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
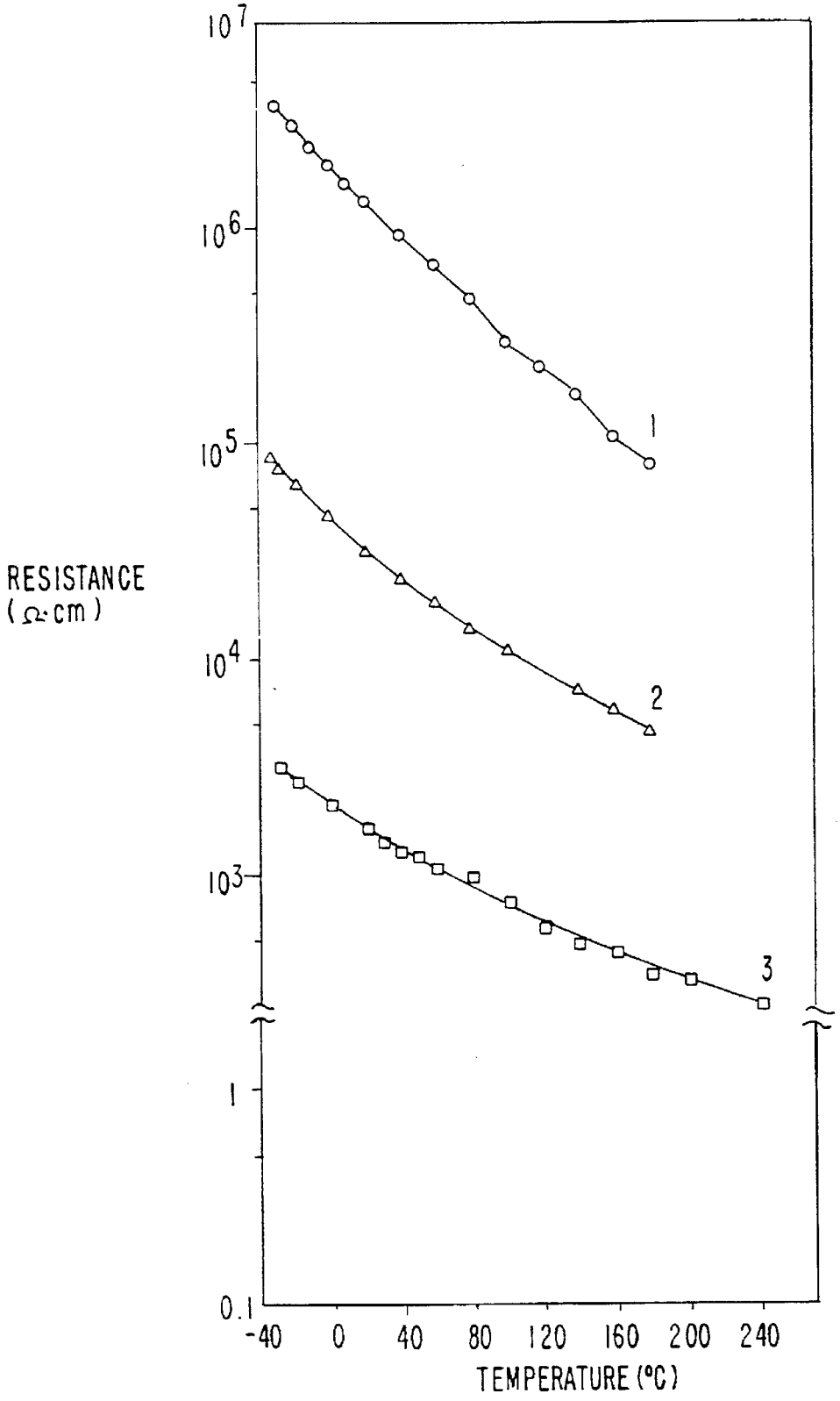
FIG. 1 is a view showing graphically a course of a specific electrical resistance as a function of a temperature for different SiC modifications.

FIG. 1 shows the course of a specific electrical resistance versus the temperature for three different SiC modifications produced by the firm Nippon Carbon and commercially available. The illustration is obtained from a data sheet from the manufacturer. It can be seen that SiC materials are manufactured with different resistance courses. The commercially available SiC materials have a resistance which greatly lowers with increasing temperature. Since these materials are frequently used for electrical heating, the course of the resistance versus temperature is usually given by the manufacturer. However, the way of influencing the resistance behavior of these materials is not known. If a person skilled in the art has the objective to find suitable SiC materials for the inventive safety device, he can use the above mentioned manufacturers data or can determine the resistance behavior himself experimentally. It is necessary to find such materials to be used as the materials for the burner plates, whose resistance changes as much as possible within the temperature region of interest.

Figure 2:
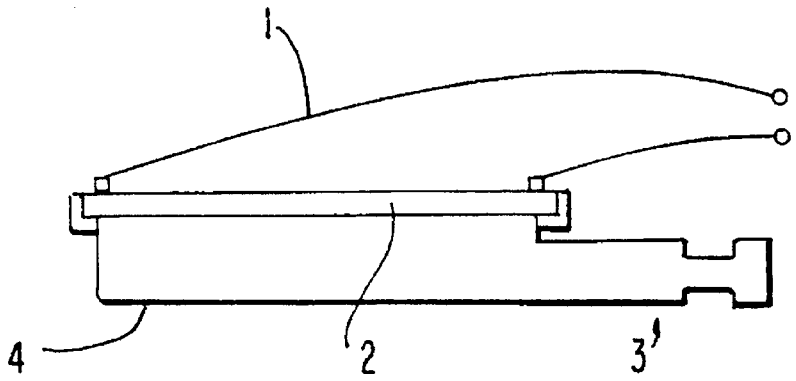
FIGS. 2–4 are views schematically showing a cross-section of a radiation gas burner in accordance with the present invention with different electrical contactings.
Figure 3:
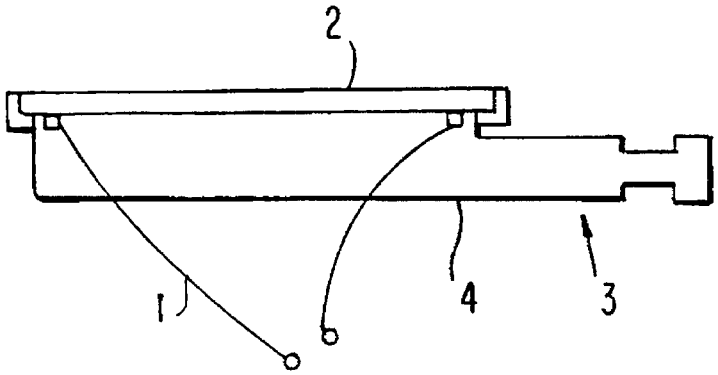
Figure 4:
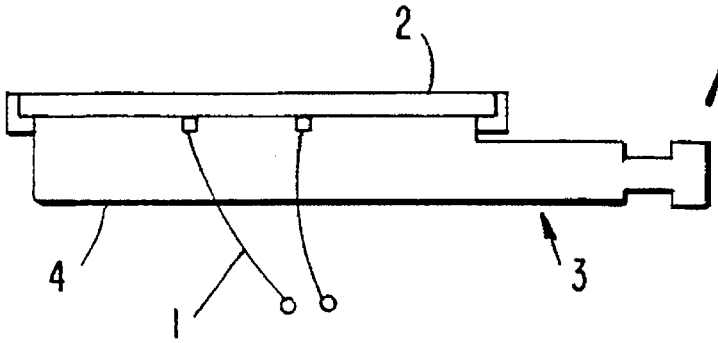

FIGS. 2–4 show different possibilities for arranging an electrical contact 1 on a burner plate 2 of a radiation gas burner in accordance with the present invention.

In the radiation gas burner shown in FIG. 2, the burner plate 2 is contacted on the upper side which is hot during the operation. In this arrangement the plate 2 must be electrically isolated from a metallic mixing chamber 4. Alternatively, the contacting can be performed on the lower side which is cold during the operation as shown in FIG. 3. The total resistance is composed in this case from the parallel circuit of the resistances on the lower and upper side of the plate 2. When a flame is present, the resistance of the upper side reduces, so that the total resistance of the arrangement lowers. As shown in FIG. 4, when the contacting is performed in the inner region of the plate 2 on the lower side, the plate 2 does not have to be isolated from the mixing chamber 4. The electrical resistance between both contact points in the hot inner region of the burner plate is substantially lower than the resistance in the outer region, so that the current flow toward the edge is negligible. Also, in this arrangement the electrical resistance during the operation is composed of a parallel connection of the resistance on the lower side of the plate 2 and the resistance on the upper side as shown in FIG. 3.

It is preferable to provide the contacting from below, since the temperature of the contact point during the operation is here so low (less than 100° C.) that many contacting methods can be used, such as for example glueing with conductive epoxy resin. The temperature on the upper side can reach over 700° C., so that practically only a welding method can be utilized.

In all above described arrangements, the ignition device, as conventional in the prior art, is mounted above the burner plate in a gas discharge passage.

An example of the radiation gas burner with a safety device in accordance with the present invention is presented hereinbelow.

A burner plate is composed of a SiC (α modification) and has a diameter of 14.5 cm and a thickness of 4 mm. Two wires of copper tinsel conductor are glued with an electrically conductive epoxy resin glue of the type Elecolit 323 a+b on the lower side of the burner plate which faces away from the flame.

Figure 5:
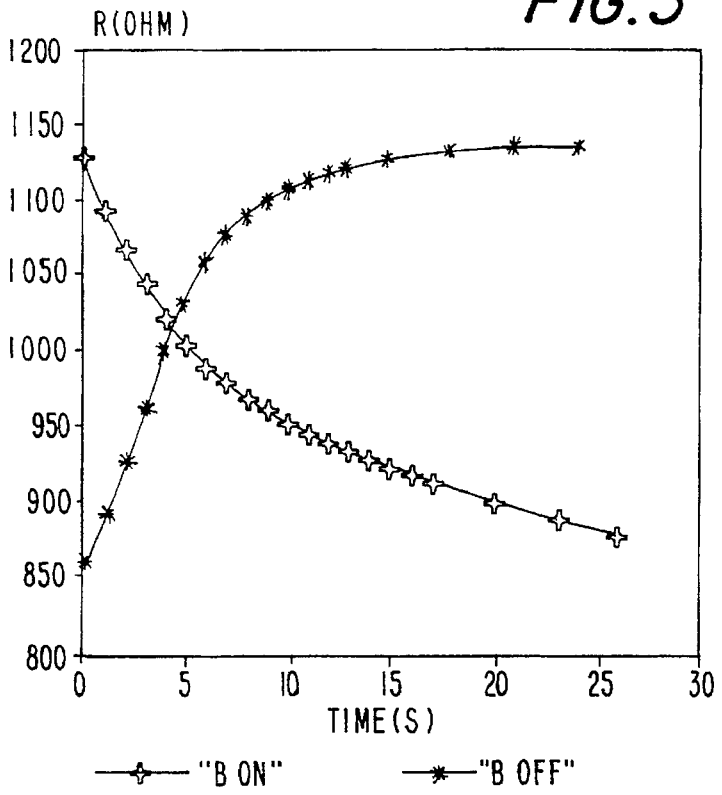
FIG. 5 is a view showing graphically a course of an electrical resistance as a function of a temperature in a heating up phase and a cooling down phase, measured on a SiC burner plate of a radiation gas burner in accordance with the present invention.
Figure 6:
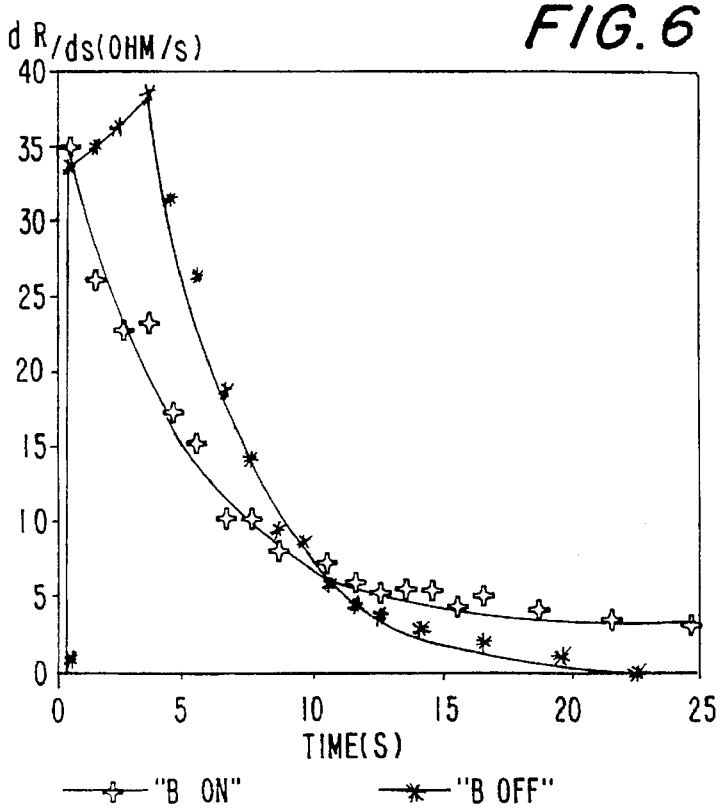
FIG. 6 is a view graphically showing a first differential of the curve of FIG. 5.

The plate is mounted on a mixing chamber which is used with glass ceramic cover for a gas range. The connecting wires pass through the bottom of the mixing chamber. The plate is supplied with 6 V alternative voltage through a pre-resistance of 470 Ω. The voltage at the pre-resistance can be recorded with a single channel recorder. The electrical resistance of the burner plate during the operation as well as its time change is calculated from the voltage drop and as shown in FIGS. 5 and 6. The curves represent the course of the calculated value during ignition or extinguishing of the flame.

As can be seen from FIGS. 5 and 6, the resistance during turning on ("B on") reduces so much that the flame can be recognized in this construction in 10 seconds within the safety time prescribed in the EN 30. Similarly, an extinguishing of the flame ("B off") is recognized within the safety time of 60 seconds.

FIG. 5 shows the absolute value of the increase. The value during the switching on ("B on") is negative, while the value during the switching off ("B off") is positive. The increase within a short time from small values is so high that it can be easily evaluated. After approximately 10 seconds, the changes in the signal are only so low that the next switching step can be detected.

In FIG. 6, instead of the absolute measuring values, speed changes of the further evaluation are subjected to further evaluation. The raises of the curves of FIG. 5 in the moments of turning on and turning off are very high. Therefore it is possible to perform the control, with which the above mentioned safety times can be not only maintained but substantially exceeded.

It will be understood that each of the elements described above, or two or more together, may also find a useful application in other types of constructions differing from the types described above.

While the invention has been illustrated and described as embodied in a radiation gas burner with a safety device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gas radiation burner, comprising a burner plate; and safety means providing an ignition safety for non-burnt discharging gas for igniting gas or interrupting a gas supply, said safety means being formed by contacting said burner plate via electrical conductors thereby forming a temperature measuring resistance of a material of said burner plate.

2. A gas radiation burner as defined in claim 1, wherein said burner plate is composed of a ceramic material.

3. A gas radiation burner as defined in claim 1, wherein said burner plate is composed of a fiber material.

4. A gas radiation burner as defined in claim 1, wherein said burner plate is composed of a SiC fiber material.

5. A gas radiation burner as defined in claim 4, wherein said temperature measuring resistance includes throughgoing SiC fibers which are interlaced in said burner plate.

6. A gas radiation burner as defined in claim 4, wherein said temperature measuring resistance includes a throughgoing SiC fiber bundle which are interlaced in said burner plate.

7. A gas radiation burner as defined in claim 1, wherein said plate has a lower side, said temperature measuring resistance electrically contacting said lower side of said plate.

8. A gas radiation burner as defined in claim 7, wherein said burner plate has an inner region, said temperature measuring resistance contacting said lower side of said plate in said inner region.

9. A gas radiation burner as defined in claim 1, wherein said burner plate has an inner region and an edge region, said temperature measuring resistance having separate temperature resistance measuring elements which contact said inner region and said edge region of said burner plate separately from one another.

10. A gas radiation burner as defined in claim 1; and further comprising an evaluating unit which is connected with said temperature measuring resistance and formed so that an interruption and a short circuiting are determined by said evaluation unit when an actual value of a resistance of said temperature measuring resistance is not in the range of the predetermined region.

11. A gas radiation burner as defined in claim 1; and further comprising an evaluating unit which is connected with said temperature measuring resistance and formed so that an interruption and a short circuiting are determined by said evaluation unit when a speed of a change of a resistance of said temperature measuring resistance is not in the range of the predetermined region.

12. A gas radiation burner as defined in claim 1; and further comprising means for igniting the gas and means for interrupting a gas supply, said temperature measuring resistance being connected with said means so as to ignite the gas or to interrupt the gas supply in case of extinguishing of a flame in response to a signal of said temperature measuring resistance.

13. A gas radiation burner, comprising a burner plate; and safety means providing an ignition safety for non-burnt discharging gas for igniting gas or interrupting a gas supply, said safety means being formed by contacting said burner plate via electrical conductors thereby forming a temperature measuring device of a material of said burner plate, said burner plate being composed of said material whose electrical resistance changes in the temperature region 100°–900° C. by at least 10%.

* * * * *